US007121752B2

(12) United States Patent
Su

(10) Patent No.: US 7,121,752 B2
(45) Date of Patent: Oct. 17, 2006

(54) MULTI-PURPOSE PEN

(75) Inventor: Yen-Chao Su, Chung Ho (TW)

(73) Assignee: Jen Jang Co., Ltd., Taipei (TW)

( * ) Notice: Subject to any disclaimer, the term of this patent is extended or adjusted under 35 U.S.C. 154(b) by 0 days.

(21) Appl. No.: 10/651,973

(22) Filed: Sep. 2, 2003

(65) Prior Publication Data

US 2004/0047671 A1 Mar. 11, 2004

(30) Foreign Application Priority Data

Sep. 10, 2002 (CN) ..... 02 2 52565

(51) Int. Cl.
*B43K 29/00* (2006.01)

(52) U.S. Cl. ..... 401/195; 401/52

(58) Field of Classification Search ..... 401/52, 401/195, 192; 362/118, 259
See application file for complete search history.

(56) References Cited

U.S. PATENT DOCUMENTS 5,143,465 A * 9/1992 Hou ..... 401/195
5,617,304 A * 4/1997 Huang ..... 362/118
5,803,583 A * 9/1998 Hsieh ..... 362/118
6,238,119 B1 * 5/2001 Liu ..... 401/195
6,682,202 B1 * 1/2004 Wong ..... 401/195

* cited by examiner

*Primary Examiner*—Tuan Nguyen
(74) *Attorney, Agent, or Firm*—Troxell Law Office PLLC

(57) ABSTRACT

A multi-purpose pen includes an upper pen shaft and a lower pen shaft joined by a hollow middle ring in between. The upper pen shaft has a cone-shaped lucent section at a rear end thereof, such that light beams emitted form an illumination module located in the upper pen shaft are passed out to an exterior via the cone-shaped lucent section. The upper pen shaft further has a pen clamp at the rear end thereof. A front edge of a reverse side of the pen clamp is disposed with a protruding object that is penetrated into a corresponding opening at the upper pen shaft, so as to touch-control a light source switch at a circuit board of the illumination module. An insulating strap is located between the circuit board and the protruding object for preventing electricity leakage.

2 Claims, 8 Drawing Sheets

MULTI-PURPOSE PEN

BACKGROUND OF THE INVENTION (a) Field of the Invention

The invention relates to a pen, and more particularly, to a multi-purpose pen that not provides writing functions, but also serves as control pen for touch panels as well as fulfilling illumination and indication purposes.

(b) Description of the Prior Art

Men have long since been targeting at providing conveniences in writing. Referring to FIG. 1 showing a prior laser pen, a laser device is placed at an interior of the laser pen, and a button 11 is provided at an exterior. When a user presses the button, light beams from a light emitting diode are emitted out to the exterior via a pen end 12. The prior laser pen is not different from ordinary pens with respect to writing functions, and therefore although the laser pen provides originality but has limited purposes. In addition, the laser pen cannot be applied to touch panels, while having high manufacturing costs without major breakthrough in appearance. Above all, the laser pen is highly likely being switched on due to unintentional contacts. Therefore, the laser pen is not widely accepted on the market. It is a vital task as how to overcome the aforesaid drawbacks.

SUMMARY OF THE INVENTION

The primary object of the invention is to provide a multi-purpose pen. Wherein, an upper pen shaft and a lower pen shaft are joined by a hollow middle ring in between; the upper pen shaft has a gradually contracted cone-shaped lucent section in an outward direction a rear end thereof, such that light beams emitted from an illumination module located in the upper pen shaft are passed out to an exterior via the cone-shaped lucent section; the upper pen shaft further has a pen clamp at the rear end thereof; a front edge of a reverse side of the pen clamp is disposed with a protruding object that is penetrated into a corresponding opening at the upper pen shaft, so as to touch-control a light source switch at a circuit board of the illumination module; and between the circuit board and the protruding object is an insulating strap for preventing electricity leak. Using the aforesaid structure, the aforesaid drawbacks of the prior art can be completely eliminated.

DETAILED DESCRIPTION OF THE PREFERRED EMBODIMENTS

To better understand contents of the invention, detailed descriptions of a preferred embodiment shall be given with the accompanying drawing hereunder.

Figure 1:
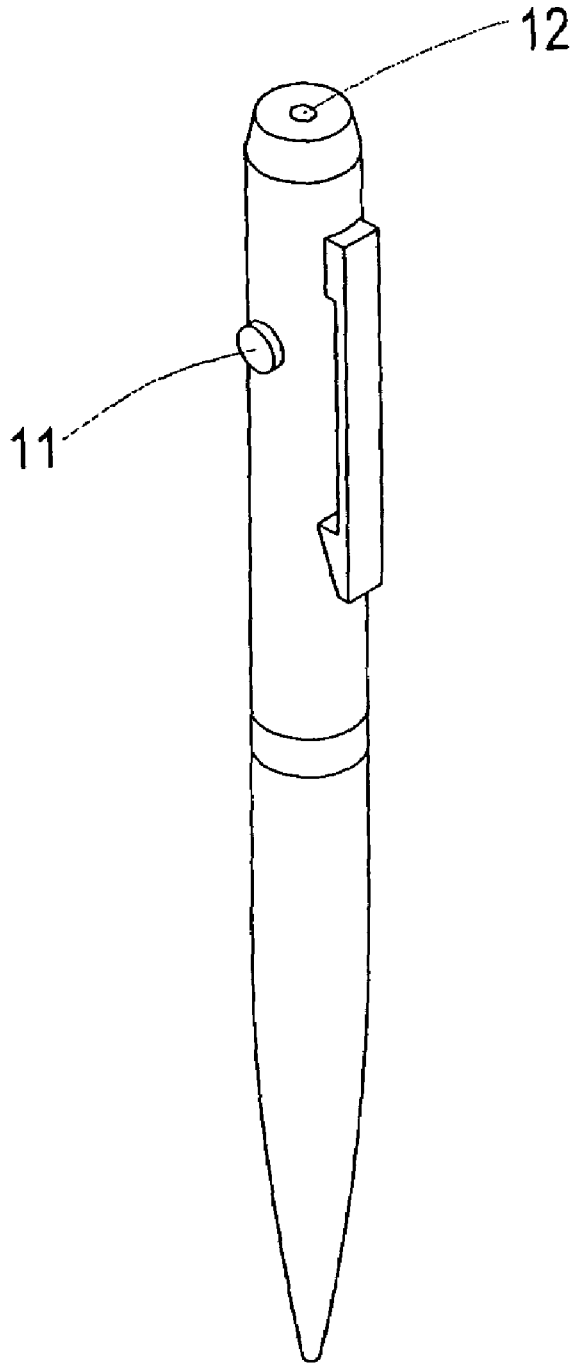
FIG.1 Prior Art
FIG. 1 shows an elevational view of a prior art.
Figure 2:
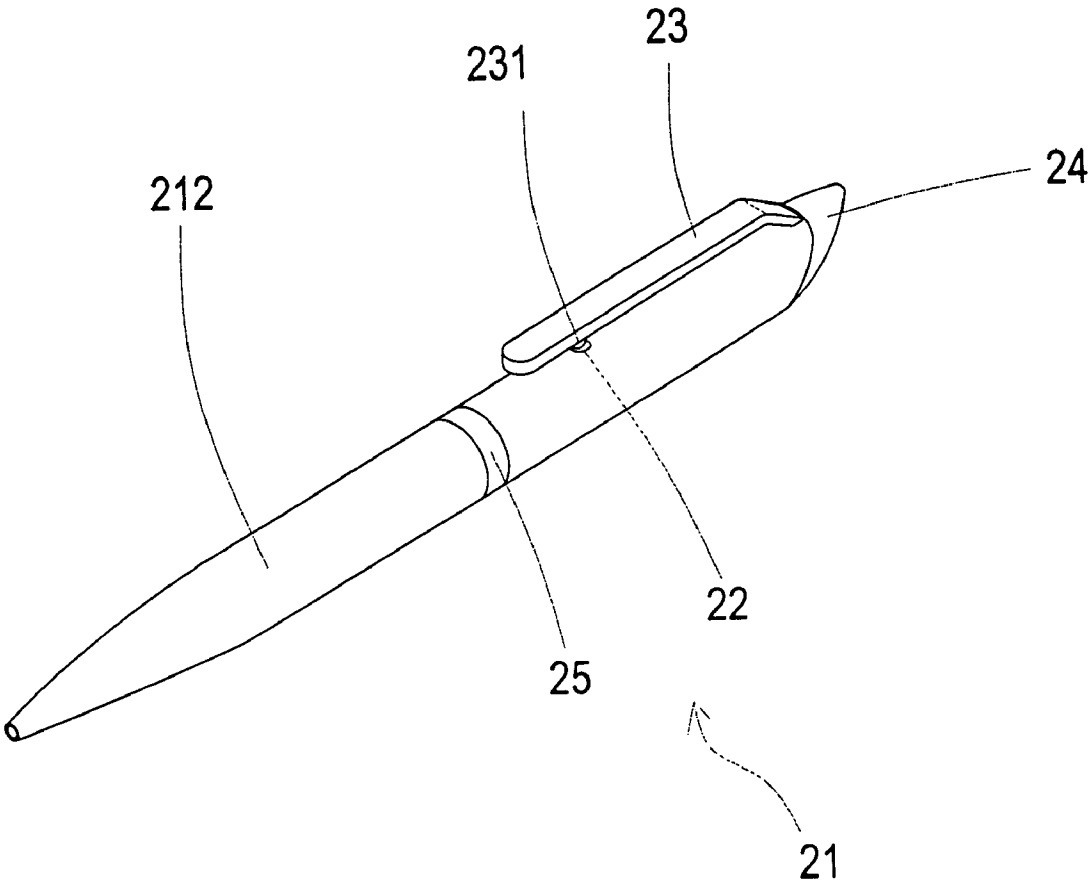
FIG. 2 shows an elevational view according to the invention.
Figure 3:
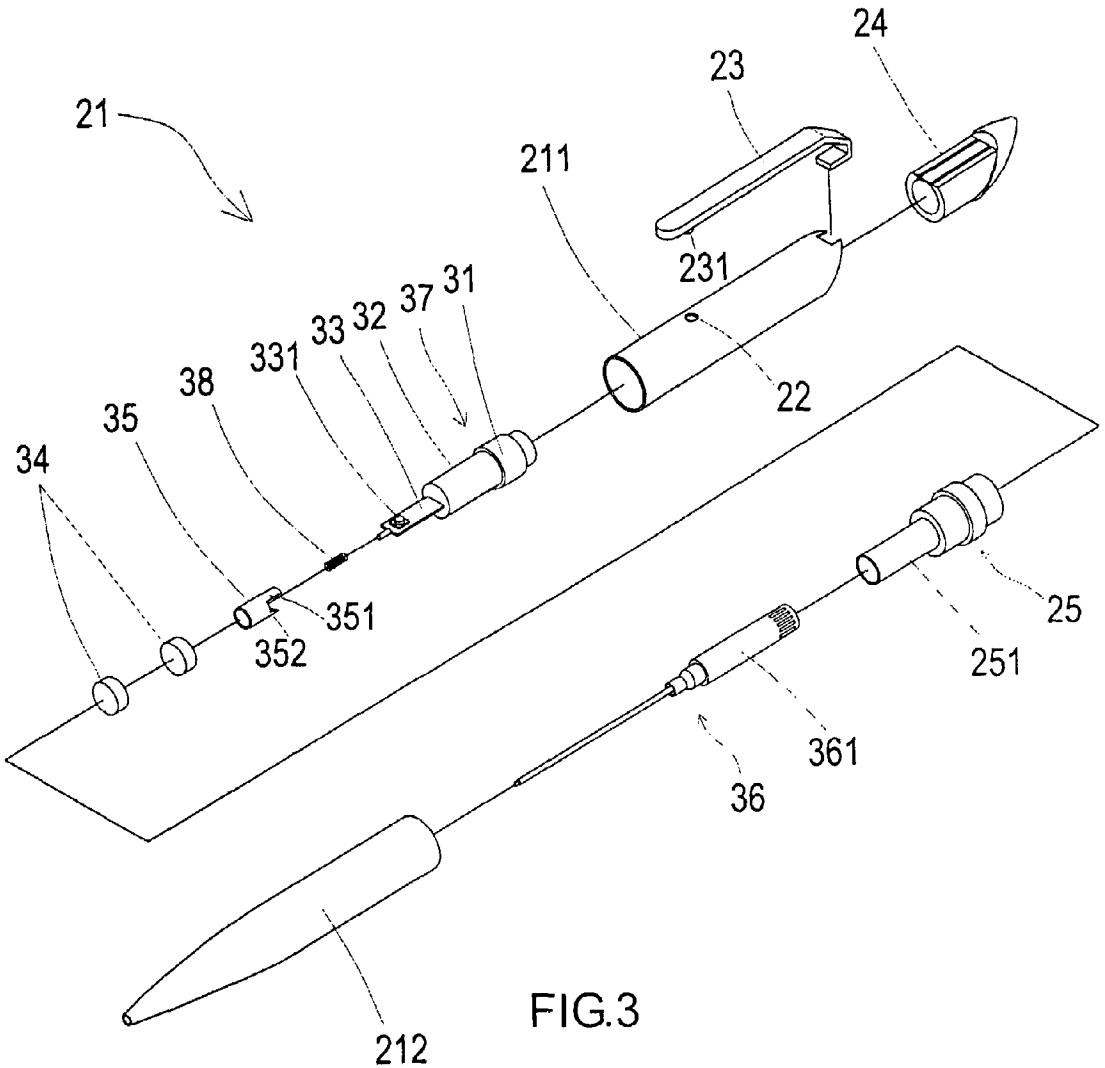
FIG. 3 shows an exploded view according to the invention.

Referring to FIGS. 2 and 3, the invention comprises an upper pen shaft 211, a lower pen shaft 212, a cone-shaped lucent section 24, a hollow middle ring 25 and a pen clamp 23. The upper pen shaft 211 and the lower pen shaft 212 are joined using the hollow middle ring 25 in between. The upper pen shaft 211 is provided with the cone-shaped lucent section 24 that is gradually contracted in an outward direction, such that light beams emitted from an illumination module 37 in the upper pen shaft 211 are passed through to an exterior via the cone-shaped lucent section 24. The upper pen shaft 211 is additionally provided with the pen clamp 23 at the rear end thereof. A front edge of a reverse side of the pen clamp 23 is disposed with a protruding object 231 that can be penetrated into a corresponding opening 22 at the upper pen shaft 211, so as to touch-control a light source switch 331 at a circuit board 33 of the illumination module 37. The illumination module 37 is consisted of a lamp shade 31, an illuminating portion 32 and a circuit board 33. The circuit board 33 is provided with a light source switch 331, and is connected with a spring 38 further connecting to a battery 34 via a lower portion thereof. The battery 34 is placed in an insulation sheath 35 to provide the circuit board with electricity. The lower pen shaft 212 has a refill 36 at an interior thereof. The refill 36 has a refill connecting portion 361 accommodated by a middle ring connecting portion 251. When rotating the lower pen shaft 212, the refill 26 is stretched out of the lower pen shaft 212, thereby extending or withdrawing the refill 36.

Figure 4:
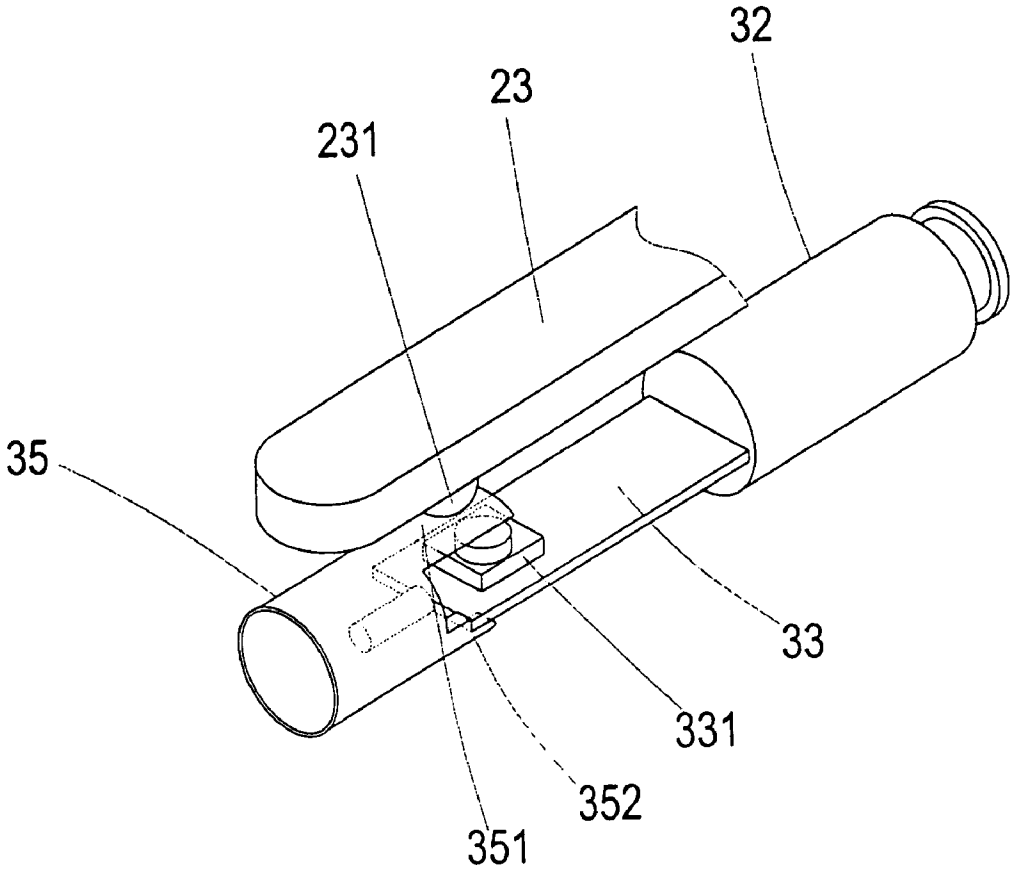
FIG. 4 shows a perspective view of a press switch according to the invention.

Referring to FIG. 4, the insulation sheath 35 is accommodated around a rear portion of the circuit board 33, and has two insulating straps 351 and 352 located between the protruding object 231 and the light source switch 331, and a rear side of the circuit board 33, respectively. The insulating strap 351 is for preventing electricity leak of the light source switch 331 via the protruding object 231 and the pen clamp 23.

Figure 5:
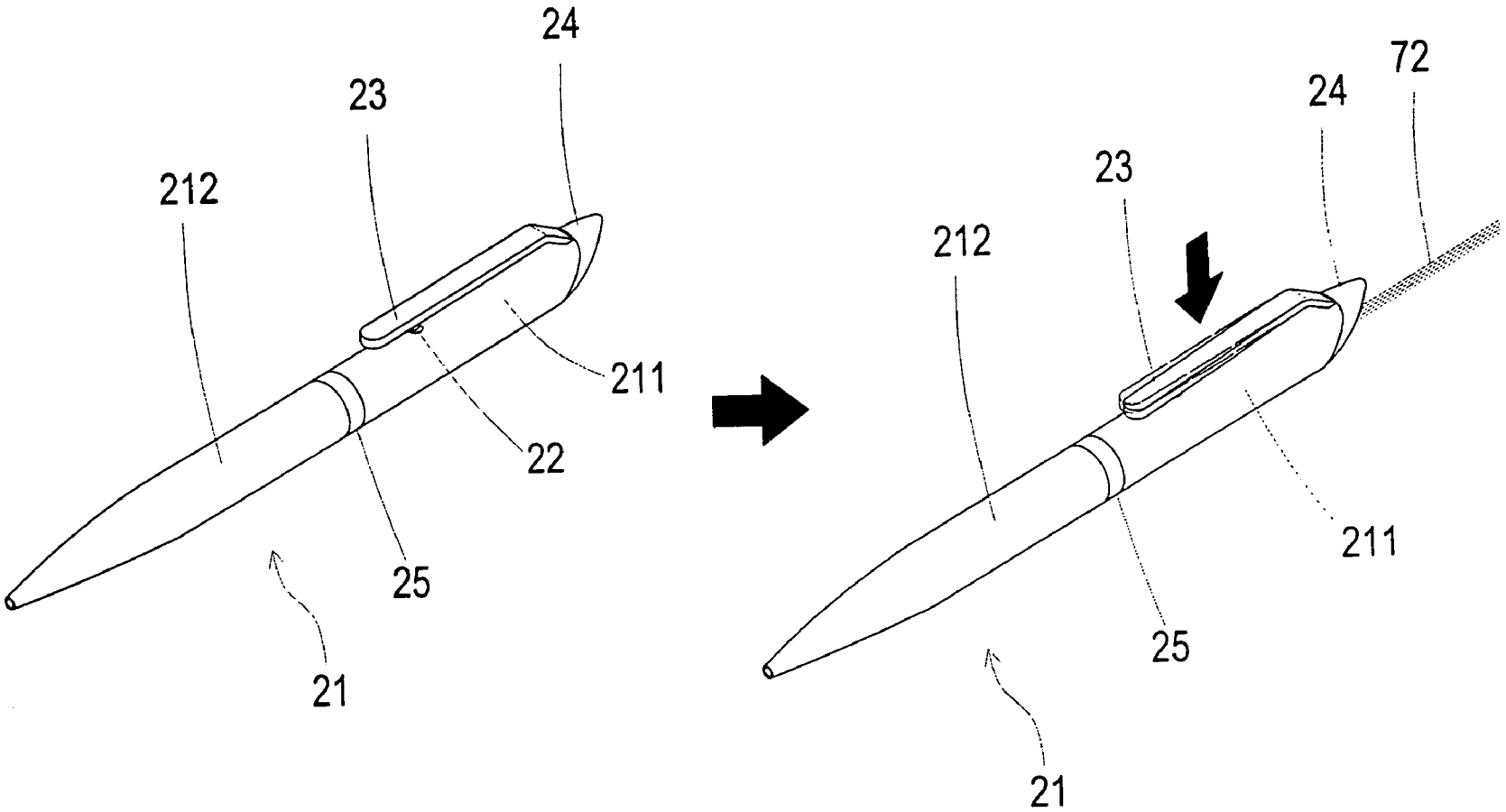
FIG. 5 shows a schematic view illustrating operation status according to the invention.

Referring to FIG. 5, the invention comprises an upper pen shaft 211, a lower pen shaft 212, a cone-shaped lucent section 24, a hollow middle ring 25 and a pen clamp 23. The upper pen shaft 211 and the lower pen shaft 212 are joined using the middle ring 25 in between. The upper pen shaft 211 is provided with the cone-shaped lucent section 24 that is gradually contracted in an outward direction, such that light beams of the light source 72 are emitted from the cone-shaped lucent section 24 when the pen clamp 23 is being pressed.

Figure 6:
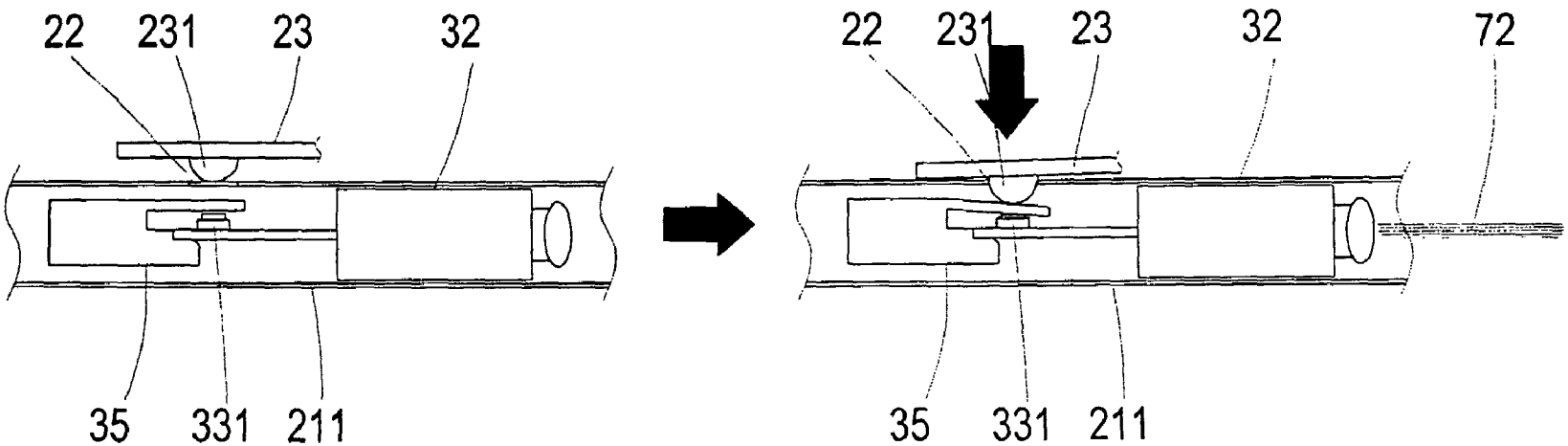
FIG. 6 shows a sectional view illustrating movements of press switching according to the invention.

Referring to FIG. 6, when pressing the pen clamp 23, the protruding object 231 is penetrated into the opening 22 at the upper pen shaft 211, and the insulating strap 351 of the insulation sheath 35 is also pressed to power on the press-control switch 331 at the circuit board 33. The circuit board 33 then drives the illumination module 37, and light beams from the light source 72 are emitted through a light exit 71 and the cone-shaped lucent section 24.

Figure 7:
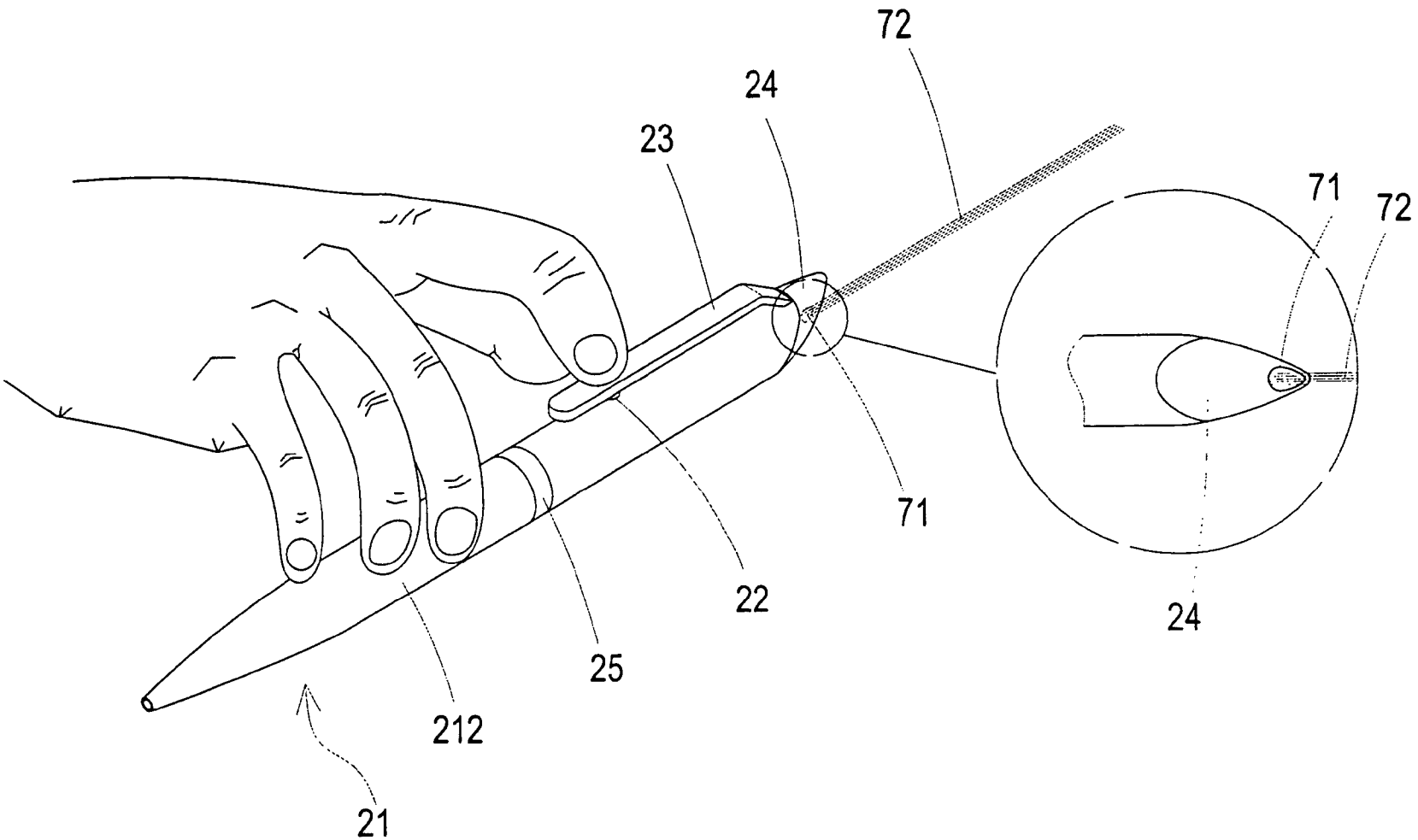
FIG. 7 shows an enlarged operational of a lucent section at a rear end of the pen according to the invention.

Referring to FIG. 7, when a user presses the pen clamp 23, an internal circuit therein is conducted, so that light beams of the light source 72 are emitted through a light exit 71 and the cone-shaped lucent section 24 to further serve for illumination or indication purposes using laser beams.

Figure 8:
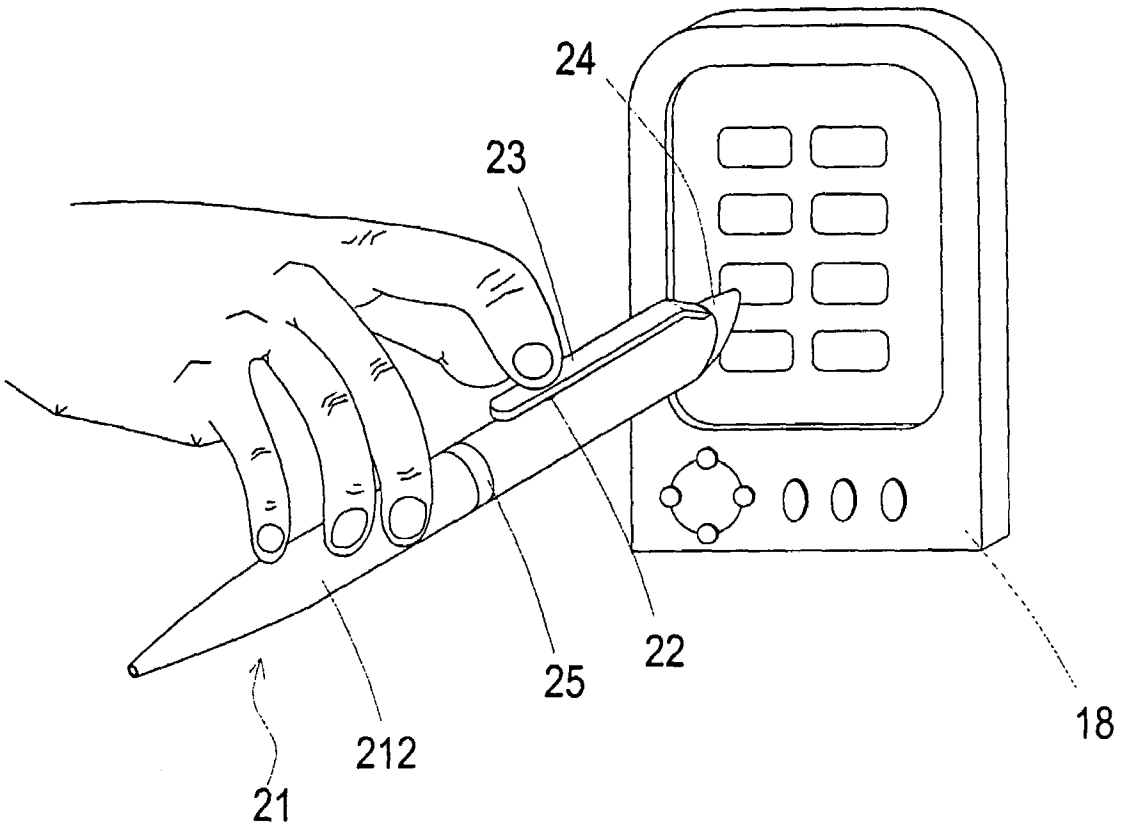
FIG. 8 shows a schematic view illustrating the invention operating a personal digital assistant (PDA).

Referring to FIG. 8, when a user wishes to control a touch panel 18, a cone-shaped end of the cone-shaped lucent section 24 may be used to lightly touch the touch panel 18.

To make the advancement and practical values of the invention more apparent, the invention is compared with the prior art.

The prior art has the following drawbacks:

1. A light source switch is disposed at one side of the pen, and is often switched on due to rolling movements of the pen or unintentional contacts. Unnecessary electricity consumption is resulted.
2. The prior invention lacks appropriate designs for controlling touch panels, and thus fails to provide certain practical values.
3. Only a function as emitting light beams from a light source is provided with limited market acceptance.
4. The prior invention lacks advancement.
5. It is obligatory to purchase special pens for controlling touch panels, and usage costs are increased.

The invention has the following excellences:

1. The light source switch is designed at a reverse side of the pen clamp having a protruding object, and can only be activated with appropriate forces applied. Not only the switch is protected, but also functions as preventing accidental power on of the switch due to rolling movements of the pen or unintentional contacts are achieved.
2. The cone shape contracted in an outward direction of the cone-shaped lucent section is handy for controlling touch panels while also having esthetical and practical values.
3. Illumination and indication functions are provided.
4. The present invention has advancement over the prior art.
5. The present invention as great market potential.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A multi-purpose pen comprising an upper pen shaft, a lower pen shaft, a cone-shaped lucent section, a hollow middle ring and a pen clamp; and the characteristics thereof being that:

the upper pen shaft and the lower pen shaft are joined by the hollow middle ring in between; the cone-shaped lucent section faces an outward direction on a rear end of the upper pen shaft such that light beams emitted from an illumination module located in the upper pen shaft are passed out to an exterior via the cone-shaped lucent section; the upper pen shaft further has a pen clamp at the rear end thereof; a front edge of a reverse side of the pen clamp is disposed with a protruding object that is penetrated into a corresponding opening at the upper pen shaft, so as to touch-control a light source switch at a circuit board of the illumination module; and between the circuit board and the protruding object is an insulating strap for preventing electrical leakage between the circuit board and the protruding object;

wherein the cone-shaped lucent section is configured to provide a tip surface for contacting a touch panel screen without scratching the screen.

2. The multi-purpose pen in accordance with claim 1, wherein the cone-shaped lucent section has a light exit, thereby emitting light beams via the light exit and allowing the cone-shaped lucent section to provide illumination and indication functions.

* * * * *